US009301034B2

(12) United States Patent
Kantor et al.

(10) Patent No.: US 9,301,034 B2
(45) Date of Patent: Mar. 29, 2016

(54) MAGNETIC SUSPENSION TRANSDUCER

(71) Applicant: Tymphany Worldwide Enterprises Limited, Grand Cayman (KY)

(72) Inventors: Kenneth L. Kantor, Berkeley, CA (US); Ioannis Kanellakopoulos, Cupertino, CA (US); Alireza Jabbari, Berkeley, CA (US)

(73) Assignee: TYMPHANY WORLDWIDE ENTERPRISES LIMITED (KY)

( * ) Notice: Subject to any disclaimer, the term of this patent is extended or adjusted under 35 U.S.C. 154(b) by 0 days.

(21) Appl. No.: 14/519,324

(22) Filed: Oct. 21, 2014

(65) Prior Publication Data

US 2015/0063624 A1 Mar. 5, 2015

Related U.S. Application Data

(62) Division of application No. 11/628,395, filed on Feb. 7, 2007.

(51) Int. Cl.
*H04R 9/06* (2006.01)
*H04R 1/00* (2006.01)
(Continued)

(52) U.S. Cl.
CPC ..... *H04R 1/00* (2013.01); *H04R 9/025* (2013.01); *H04R 9/06* (2013.01); *H04R 9/066* (2013.01); *H04R 11/02* (2013.01); *H04R 25/00* (2013.01); *H04R 2209/041* (2013.01)

(58) Field of Classification Search
CPC ..... H04R 9/025; H04R 9/046; H04R 9/047; H04R 9/06; H04R 9/063; H04R 9/066; H04R 11/02; H04R 25/606; H04R 2209/024; H04R 2209/041; H04R 2460/13
USPC ..... 381/322, 324, 326, 328, 380, 412, 414, 381/396, 417, 418, 420, 421; 600/25; 607/55, 56, 57; 335/205, 207, 220, 257
See application file for complete search history.

(56) References Cited

U.S. PATENT DOCUMENTS 5,624,376 A 4/1997 Ball
6,217,508 B1 * 4/2001 Ball et al. ..... 600/25
(Continued)

FOREIGN PATENT DOCUMENTS

WO 9613960 A1 5/1996

OTHER PUBLICATIONS

Kenneth L Kantor, "Compact Magnetic Suspension Transducer", AES 117th Convention, San Francisco, CA, USA, Oct. 28-31, 2004, pp. 1-7.
(Continued)

*Primary Examiner* — Huyen D Le
(74) *Attorney, Agent, or Firm* — Cantor Colburn LLP

(57) ABSTRACT

A method for operating an acoustic transducer is provided. The acoustic transducer includes a moving element and a fixed element, wherein the moving element is coupled to surrounding air. In the method, a signal-independent magnetic field is generated to urge the moving element into a rest position when no input signal is received; and a force is generated in response to the input signal and applying that force to the moving element to urge the moving element away from the rest position. The moving element is controlled by a combined influence of the signal-independent magnetic field and the signal-dependent force to generate acoustic vibrations in response to an audio input signal.

8 Claims, 8 Drawing Sheets

(51) Int. Cl.

| | |
|---|---|
| ***H04R 9/02*** | (2006.01) |
| ***H04R 11/02*** | (2006.01) |
| *H04R 25/00* | (2006.01) |

(56) References Cited

U.S. PATENT DOCUMENTS

| | | | | |
|---|---|---|---|---|
| 6,242,994 | B1 * | 6/2001 | Li et al. | 335/277 |
| 6,735,318 | B2 | 5/2004 | Cho | |
| 6,838,963 | B2 | 1/2005 | Zimmerling | |
| 7,190,247 | B2 * | 3/2007 | Zimmerling | 335/205 |
| 2004/0097785 | A1 | 5/2004 | Schmid | |

OTHER PUBLICATIONS

Written Opinion for corresponding application PCT/US2005/019557 filed Jun. 3, 2005; Mail date Oct. 12, 2005.

International Search Report for corresponding application PCT/US2005/019557 filed Jun. 3, 2005; Mail date Oct. 12, 2005.

International Preliminary Report on Patentability for corresponding application PCT/US2005/019557 filed Jun. 3, 2005; Mail date Dec. 4, 2006.

* cited by examiner

MAGNETIC SUSPENSION TRANSDUCER

CROSS-REFERENCE TO RELATED APPLICATIONS

The present invention is a divisional of U.S. patent application Ser. No. 11/628,395 filed Feb. 7, 2007, which is a National Phase entry of International Patent Application Serial Number PCT/US05/019557 filed Jun. 3, 2005, which claims priority to U.S. Provisional Application Ser. No. 60/622,119 filed Oct. 25, 2004, and U.S. Provisional Patent Application Ser. No. 60/577,149 filed Jun. 3, 2004, where the contents of all of said applications are herein incorporated by reference in their entirety.

TECHNICAL FIELD

The present invention pertains generally to acoustic transducers such as loudspeakers and headphones that may be constructed without the use of compliant, flexible or elastic materials.

BACKGROUND ART

Loudspeakers and headphones are devices that transform electrical signals into acoustic vibrations. This process requires that the loudspeaker or headphone contain moving parts that excite sound waves in the surrounding air either directly or indirectly through intermediate vibrating structures. These moving parts must be suspended in some manner that allows them to move over the distance and frequency range necessary to produce the desired sound output. Traditionally, flexible materials such as rubber and fabric are used to construct loudspeaker and headphone suspension systems. These flexible materials are used to interconnect those more rigid elements that move with respect to the loudspeaker or headphone housing. Generally, the flexible elements in a loudspeaker or headphone are referred to as "soft parts." These soft parts are difficult to manufacture and are subject to fatigue and wear.

DISCLOSURE OF INVENTION

One object of the present invention is to eliminate or at least reduce the reliance on flexible elements in the construction of loudspeakers and headphones. Another object of the present invention is to provide good low-frequency response from an acoustic transducer that is compact in its physical dimensions.

These objects are achieved by proper application of magnetic force in the operation of loudspeakers and headphones to perform at least some of the functions traditionally performed by flexible elements. The motion of a magnet is controlled by the combined influence of static and signal-dependent dynamic magnetic fields, and this motion causes vibrations in the surrounding air or in a suitable intermediate medium.

According to one aspect of the present invention, an acoustic transducer includes a magnetic element and an electromagnetic element in proximity with the magnetic element. The magnetic element contains some permanently magnetic material and is located inside an apparatus such as a tube that restricts the relative motion between the magnetic element and the electromagnetic element to a path that is substantially a straight line. The magnetic element that is located inside the tube is referred to herein as an "internal magnetic element". The tube may be constructed of any material that is non-magnetic, preferably non-conductive, durable, reasonably structurally rigid, reasonably resistant to heat, and either has a reasonably low coefficient of friction or is suitable for use with a lubricant that reduces friction between the tube and the internal magnetic element. For example, the tube may be constructed of glass or a plastic such as polyetheretherketon, polyetherimide, or fluoropolymer, or a glass-filled or mica-filled plastic. The electromagnetic element may be, for example, a wound coil attached to the outside or the inside of the tube that generates a signal-dependent magnetic field in response to an electrical signal. This signal-dependent magnetic field interacts with the magnetic field of the internal magnetic element, causing the internal magnetic element and the tube-coil assembly to vibrate relative to each other along the path essentially defined by the tube in response to varying electrical signals. A lubricant may be used inside the tube to reduce friction between the internal magnetic element and the tube and to reduce spurious noise generation. A ferromagnetic liquid is particularly suitable as a lubricant because it has low viscosity, it is partially held in its intended place around the internal magnetic element by the magnetic field of that element, and it acts to direct the magnetic force.

In one embodiment of the present invention, the position of the internal magnetic element is constrained and the tube-coil assembly is essentially free to move in response to a varying electrical signal applied to the electromagnetic element. In another embodiment of the present invention, the position of the tube-coil assembly is constrained and the internal magnetic element is essentially free to move in response to a varying electrical signal applied to the electromagnetic element. In principle, both the internal magnetic element and the tube-coil assembly are free to move in response to a varying electrical signal that is applied to the electromagnetic element. In all cases, however, the internal magnetic element and the tube-coil assembly move relative to each other. For each of the cases referred to in this discussion, any element that is allowed to move is referred to herein as a movable element. One or more other magnets may be provided to generate a magnetic field that applies a restoring force to all movable elements, urging the internal magnetic element and the tube-coil assembly to return to a nominal rest position with respect to one another. These one or more other magnets provide a force that is analogous to the restoring force applied by traditional flexible elements. The nominal rest position is preferably such that the internal magnetic element contained inside the tube rests at or near the midpoint of the tube, namely the point along the longitudinal axis of the tube that is equidistant from the ends of the tube-coil assembly. This arrangement allows the maximum symmetric relative displacement for a given length of the tube-coil assembly. These other magnets may be permanent magnets or electromagnets, and they may be arranged in a variety of ways as described below.

In one implementation of the present invention, restoring forces are applied by one or more fixed magnets that are attached to the outside of the tube-coil assembly at or near the nominal rest position with their polarity arranged so that there is an attractive force between these one or more fixed magnets and the internal magnetic element, urging all movable elements to move toward their nominal rest positions.

In another implementation of the present invention, restoring forces are applied by a ferromagnetic metal foil that is wrapped around the center section of the tube-coil assembly. An attractive force between this metal foil and the internal magnetic element urges all movable elements to return to their nominal rest positions. A ferromagnetic material such as "mu-Metal" is particularly suitable in this use.

In yet another implementation of the present invention, restoring forces are applied by fixed magnets that are attached to the tube-coil assembly at locations away from the nominal rest position with their polarity arranged so that there is a repelling force between the fixed magnets and the internal magnetic element.

More than one coil may be used to create a relative motion between the internal magnetic element and the tube-coil assembly. For example, two coils can be used in a "push-pull" configuration in which the magnetic fields generated by the two coils have the same polarities so that, for the nominal operation where the center of the internal magnetic element is located between the center of the first coil and the center of the second coil, the magnetic field of the first coil pushes the internal magnetic element away from the center of the first coil when the magnetic field of the second coil pulls the internal magnetic element towards the center of the second coil and vice versa.

Either or both ends of the tube may be closed and the vibration of the tube-coil assembly that supports the internal magnetic element may be coupled mechanically to a radiation amplifier that may be an object external to or integrated with the tube-coil assembly to generate sound waves in the air. In the case where the radiation amplifier is an external object, the tube-coil assembly may be attached to the object in a manner that allows the vibration of the tube-coil assembly to be transmitted to and amplified by the object.

If desired, one or more additional internal magnetic elements may be used.

The size of a transducer according to the present invention may be adapted to satisfy specific requirements of the intended audio application including the desired sound pressure level that the transducer is expected to generate. In headphone applications where compact size is important, for example, the length of the tube-coil assembly may be approximately 3 cm and its diameter may be approximately 1 cm. Smaller or larger dimensions may be used as desired. In applications where higher sound pressure levels are needed, multiple transducers may be combined.

Preferably, the outer diameter of the internal magnetic element is slightly smaller than the inner diameter of the tube so that the relative motion between the internal magnetic element and the tube-coil assembly can occur freely along the line of intended movement without significant movement in other directions. The length of the internal magnetic element may be any convenient length. A length that is approximately 2-3 times smaller than the inner length of the tube is suitable for many implementations.

The tube-coil assembly may be composed of several components that are assembled using a process such as gluing or sonic welding to simplify the assembly procedure of the magnetic suspension transducer and to allow for the optimal design of each component. These components are preferably designed in a fashion that allows a close fit so that the overall structure has high rigidity and so that any lubricating fluid inside the tube is prevented from leaking. In a preferred embodiment, the central section of the tube nearest the coil is made from a non-conductive material to avoid reducing the effectiveness of the coil in undesirable ways such as through the induction of eddy currents in the material. The components located at some distance from the coil may generally be constructed of materials selected without regard to their conductivity.

In typical applications, either the tube-coil assembly or the internal magnetic element is attached to an external structure. In headphone applications, for example, either element may be attached to a headband that allows the transducer to be positioned in proximity to a listener's ears. The attached element is considered to be a constrained element while the other element is considered to be a movable element; however, in either case, both elements move because the principle of action-reaction applies. The total force acting on the internal magnetic element is essentially equal in magnitude and opposite in direction to the force acting on the tube-coil assembly. This force is the aggregate of the electromagnetic force of the coil and the restoring forces of the restoring magnets. As a result, even the constrained element will vibrate to some extent. The magnitude of this vibration is proportional to the force acting on the constrained element and inversely proportional to the total mass of the constrained element and the structure to which it is attached.

In one embodiment of the present invention, the constrained element that is attached to the external structure is the tube-coil assembly. In this case, the internal magnetic element is free to move inside the tube and is considered to be the movable element.

In another embodiment of the present invention, the constrained element is the internal magnetic element. For example, the internal magnetic element may be connected to a rod that protrudes through one end of the tube-coil assembly and provides a mounting point to an external structure. In this case, the tube-coil assembly is considered to be the movable element because it is free to move around the internal magnetic element.

The mechanical efficiency of the magnetic suspension transducer is directly related to the efficiency of the magnetic circuit formed by the internal magnetic element and the electromagnetic coil. The shape and material composition of the internal magnetic element, as well as its relative position with respect to the electromagnetic coil, can significantly affect the efficiency of the magnetic circuit.

In one embodiment of the present invention, the internal magnetic element is a cylindrical or annular slug made of a permanent magnetic material, such as Neodymium Iron Boron (NdFeB). In this embodiment, the one or more electromagnetic coils are preferably wound as close to the outer surface of the tube as possible. This reduces the gap between the one or more coils and the internal magnetic element and improves the efficiency of the magnetic circuit. The length of these one or more coils may be approximately equal to the length of the internal magnetic element. A ferromagnetic liquid may be used to form bearings that facilitate and stabilize the relative motion between the internal magnetic element and the tube-coil assembly. In a preferred embodiment, the ferromagnetic liquid is concentrated towards certain points on the internal magnetic element through the action of the magnetic field shape of the internal magnetic element.

In another embodiment of the present invention, the internal magnetic element has a structure similar to the motors of conventional transducers. For example, the internal magnetic element may be composed of a cylindrical or annular slug made of a permanent magnetic material, such as Neodymium Iron Boron (NdFeB), which is attached on one side to a cylindrical or annular slug made of a ferromagnetic material such as steel, and this composite two-piece slug is attached on the other side to a cylindrical or annular housing also made of a ferromagnetic material such as steel. The housing surrounds the slug made of a permanent magnetic material. The outer diameter of the slug made of a permanent magnetic material is slightly smaller than the inner diameter of the housing and the gap between them has an annular shape. The electromagnetic coil is attached to the inside of the tube and is normally positioned inside the annular gap between the outer diameter of the slug and the inner diameter of the housing. In this configuration, the magnetic field lines emanating from the permanent magnet are concentrated inside the ferromagnetic material of the top and bottom slugs and the housing. This implies that the magnetic field inside the annular gap is very strong and, therefore, the magnetic circuit is very efficient. A ferromagnetic liquid may be used as a lubricant inside the annular gap and around the ferromagnetic housing to facilitate and stabilize the motion of the tube-coil assembly relative to the internal magnetic element.

The present invention and its preferred implementations may be better understood by referring to the following discussion and the accompanying drawings in which like reference names refer to like elements in the several figures. The contents of the following discussion and the drawings are set forth as examples only and should not be understood to represent limitations upon the scope of the present invention. For example, various implementations that are described above and in the following discussion use tubes to support the internal magnetic element; however, the use of a tube or cylinder is not essential.

DETAILED DESCRIPTION

Figure 1:
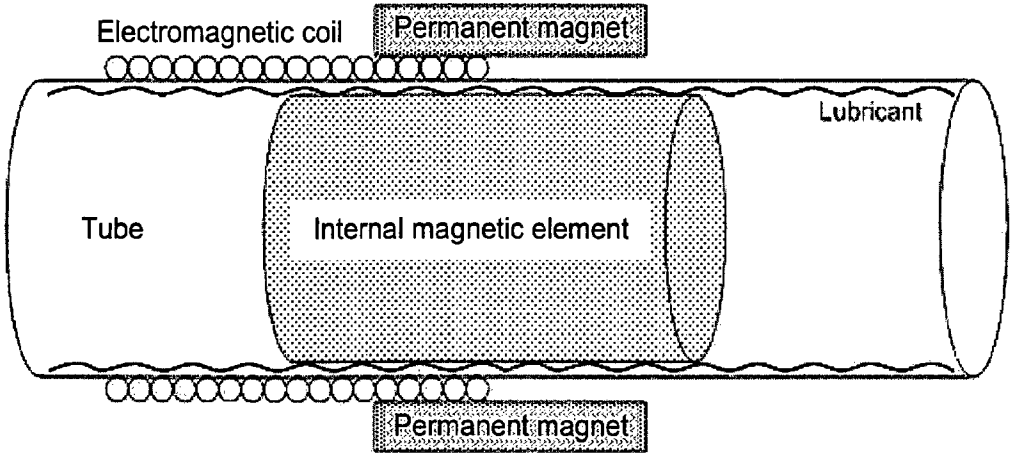
FIG. 1 is a schematic illustration of an implementation of an acoustic transducer according to the present invention in which the restoring force is created by one or more permanent magnets attached near the center of the tube.

FIG. 1 shows one implementation of the present invention in which a tube supports an internal magnetic element such that it can move freely along the length of the tube. A restoring force is applied to the internal magnetic element by two permanent magnets with their centers at or near the midpoint of the tube, namely a location along the longitudinal axis of the tube that is equidistant from the ends of the tube. Preferably the two permanent magnets are positioned around the tube and oriented so that they apply a net restoring force to the internal magnetic element that is substantially parallel to the long axis of the tube. The restoring force attracts the internal magnetic element toward its nominal rest position, which in this implementation is at or near the point along the length of the tube that is equidistant from the ends of the tube. Preferably the magnetic field axes of the permanent magnets and the internal magnetic element are parallel to the long axis of the tube. A signal-dependent force is applied to the internal magnetic element by an electromagnetic coil that is wrapped around the tube at or near the nominal rest position of the internal magnetic element. In principle, the electromagnetic coil may have essentially any length and position but, in the implementation shown in the figure, the coil has a length that is approximately equal to the length of the internal magnetic element and is positioned so that its rightmost edge is approximately 1-3 mm to the left of the nominal rest position of the internal magnetic element. The internal magnetic element has a cylindrical shape without a hole in the middle and is surrounded by a ferromagnetic liquid that acts as a lubricant and also as a sealant of the gap between the outer diameter of the internal magnetic element and the inner diameter of the tube; this allows the vibration of the internal magnetic element to be coupled more effectively to the air in the tube on both sides of the internal magnetic element so that sound waves and infrasonic vibrations are transmitted more efficiently out of the tube, which is open at both ends. In this implementation, the transducer is acting as a direct radiator of sound waves.

Figure 2:
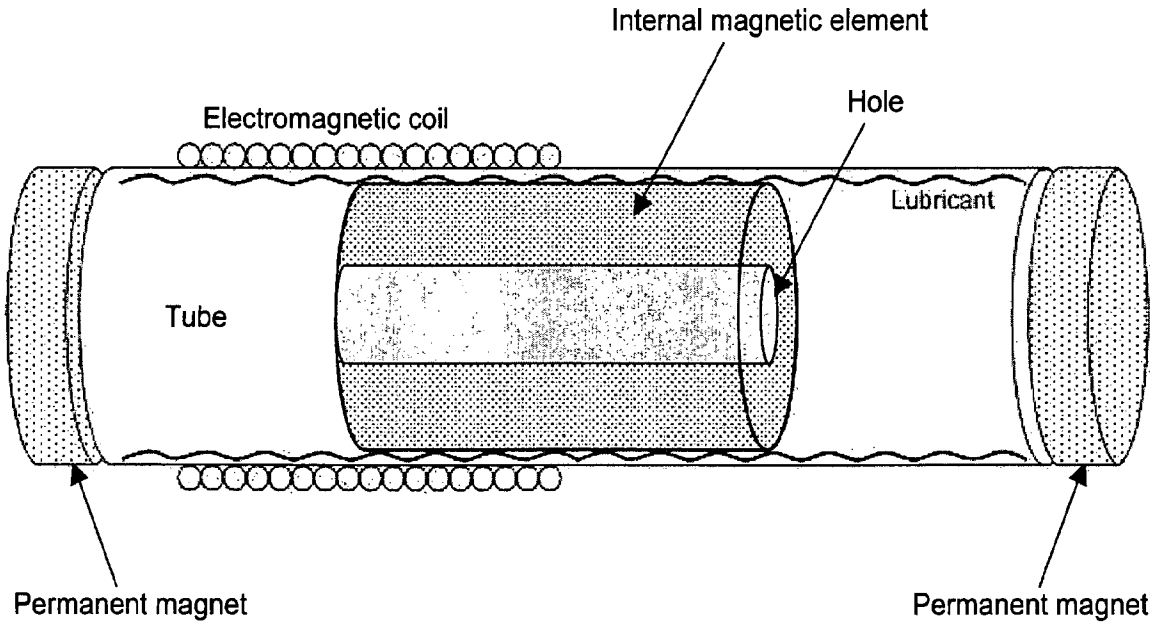
FIG. 2 is a schematic illustration of another implementation of an acoustic transducer according to the present invention in which the restoring force is created by magnets attached at the ends of the tube.

FIG. 2 shows another implementation of the present invention that is similar to the implementation shown in FIG. 1 and described above. The restoring force is provided by two permanent magnets that are attached at or near the ends of the tube. The permanent magnets apply a repulsive force to the internal magnetic element, which pushes the internal magnetic element toward its nominal rest position. A hole in the internal magnetic element allows the internal magnetic element to move more easily through the air inside the tube, which is closed on both ends. In this implementation, the vibration of the tube is coupled to the surrounding air to generate sonic and infrasonic waves. This arrangement can be used in headphone applications, where the transducer is placed in close proximity to or in actual contact with the pinna or meatus of the human ear. A sealed transducer is preferable in this type of application.

Figure 3:
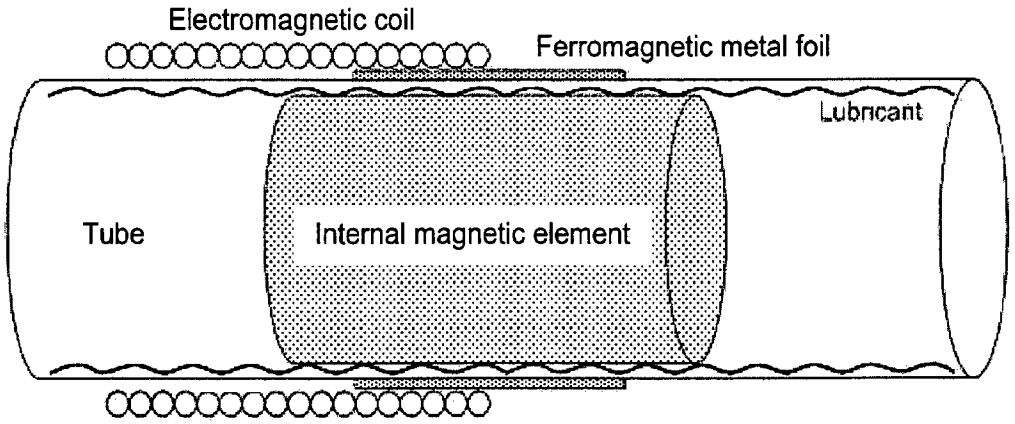
FIG. 3 is a schematic illustration of yet another implementation of an acoustic transducer according to the present invention in which the restoring force is created by a ferromagnetic metal foil attached to the outside surface of the tube.

FIG. 3 shows yet another implementation of the present invention that is similar to the implementation shown in FIG. 1. A restoring force is applied to the internal magnetic element by a ferromagnetic metal foil wrapped around the center section of the coil. The foil may be made of a mu-Metal. The restoring force attracts the internal magnetic element toward its nominal rest position.

Figure 4:
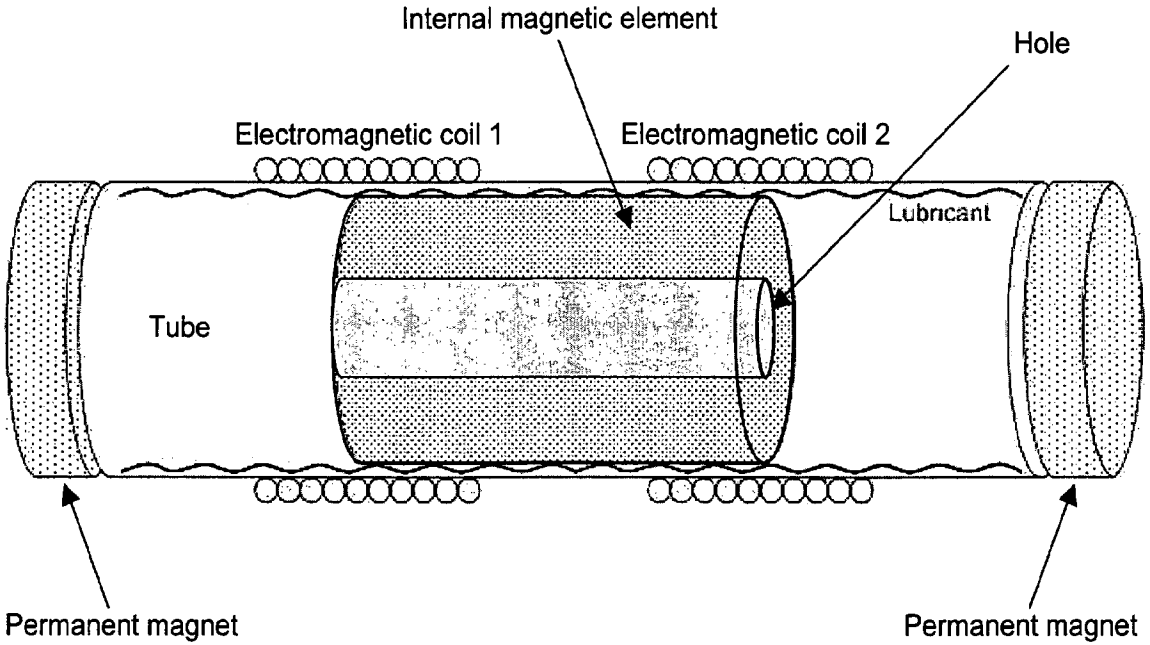
FIG. 4 is a schematic illustration of a further implementation of an acoustic transducer according to the present invention in which two coils are used to create signal-dependent dynamic magnetic fields acting on the internal magnetic element.

FIG. 4 shows another implementation of the present invention that is similar to the implementation shown in FIG. 2. A signal-dependent magnetic force is applied to the internal magnetic element by two electromagnetic coils that are wrapped around the tube on either side of the nominal rest position of the internal magnetic element. The direction of the windings for the two coils and the polarity of the signals that drive the two coils are arranged so that the magnetic fields generated by the two coils are in the same direction. In this arrangement, the magnetic field generated by one coil pushes the internal magnetic element when the magnetic field generated by the other coil pulls the internal magnetic element.

Figure 5:
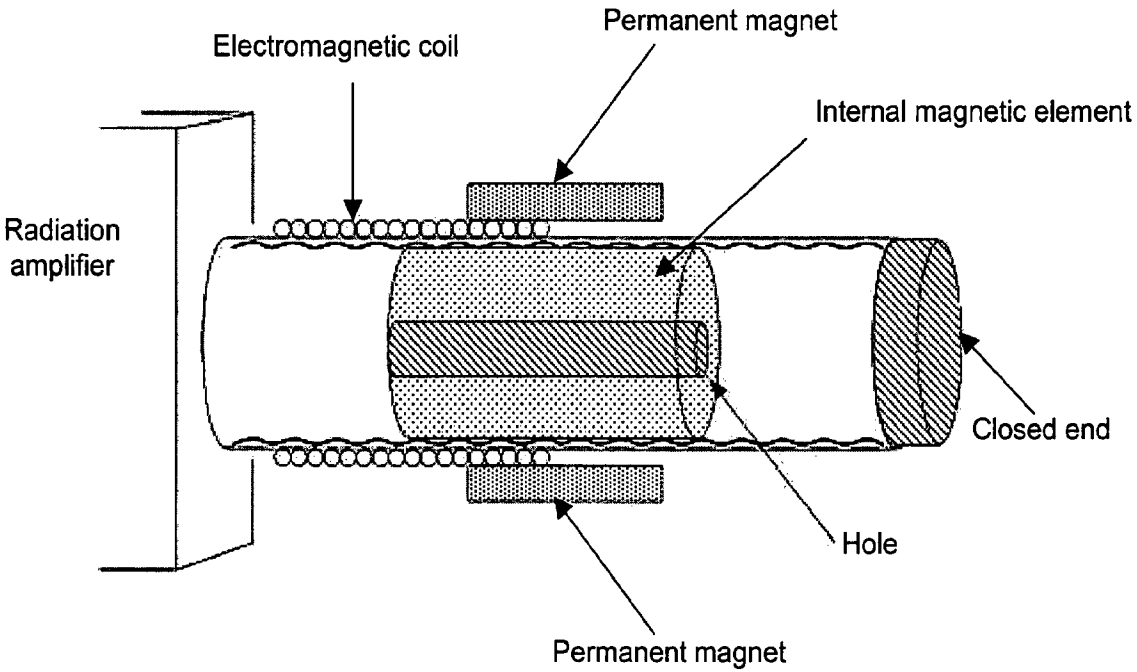
FIG. 5 is a schematic illustration of an implementation of an acoustic transducer according to the present invention in which sound is radiated by a radiation amplifier that is coupled to the tube or apparatus that supports the internal magnetic element.

FIG. 5 shows an implementation of the present invention that is similar to the implementation shown in FIG. 1 but includes a radiation amplifier. The radiation amplifier may be an external object that is attached to the tube by essentially any method that may be desired including gluing or sonic welding, for example, or the tube and radiation amplifier may be fabricated as an integral article. Vibrations of the tube are coupled to the radiation amplifier, which allows the radiation amplifier to radiate sound waves and infrasonic waves having a higher amplitude because of its larger surface area. Preferably, the size and composition of the radiation amplifier are chosen to control its resonant frequency to achieve a desired frequency response of the transducer.

Figure 6:
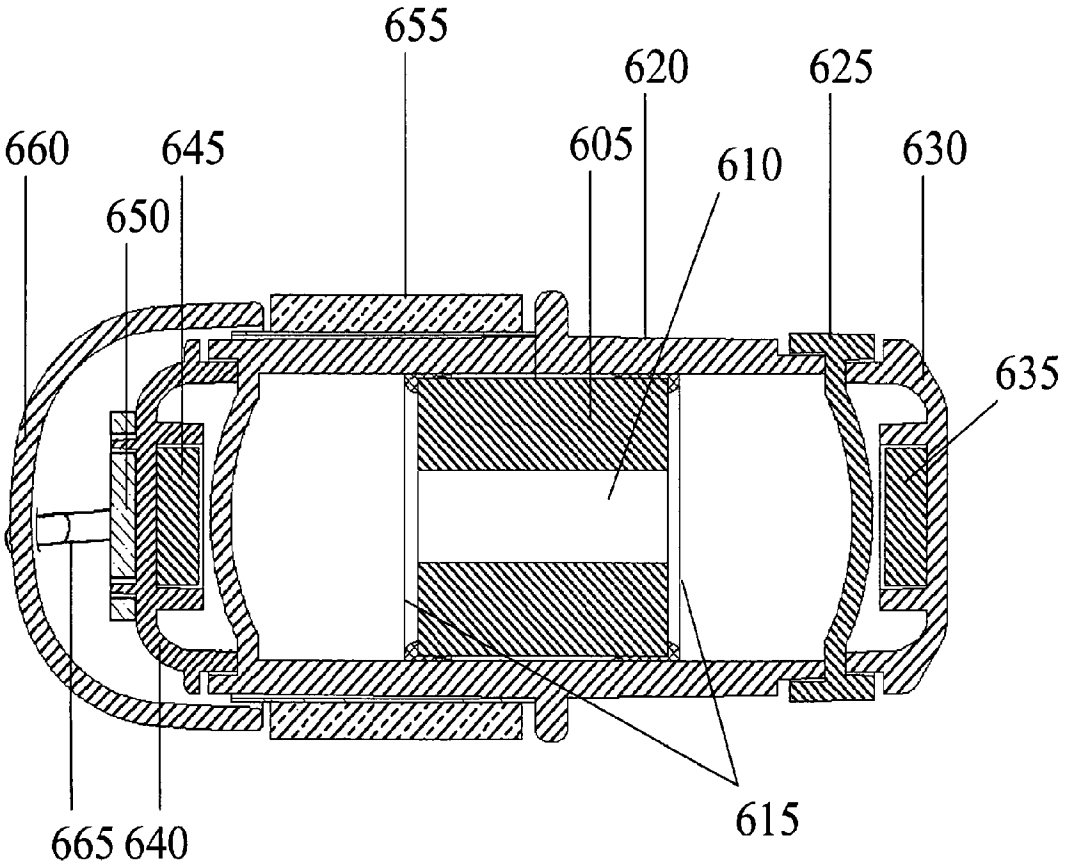
FIG. 6 is a schematic cross-sectional illustration of an implementation of an acoustic transducer according to the present invention in which the tube-coil assembly is composed of multiple pieces.

FIG. 6 shows a cross-sectional view of an assembly that facilitates the manufacture of the implementation shown in FIG. 2. The internal magnetic element 605 has an annular shape with a hole 610 in the middle to allow air to pass through, and is surrounded on either end by rings 615 of a ferromagnetic liquid that act as a lubricant to reduce the friction during the relative motion between the internal magnetic element 605 and the tube-coil assembly. The tube-coil assembly is composed of a central section 620, a closing cap 625, a magnet cap 630 that holds a permanent magnet 635, another magnet cap 640 that holds a permanent magnet 645 and a wire connection board 650, the electromagnetic coil 655 and the end cap 660. The wire connection board 650 provides a convenient connection between the leads of the electromagnetic coil 655 and the cable 665 that connects the acoustic transducer to an external signal source. The end cap 660 protects the wire connection board 650 from potentially damaging contact with foreign objects. In the structure illustrated in FIG. 6, the permanent magnets 635 and 645 are separated from the central section of the tube 620 to prevent the ferromagnetic liquid 615 from attaching to those magnets. The central tube section 620, the end cap 625, the magnet caps 630 and 640, and the end cap 660 may all be made of the same material or they could be made of different materials. For example, the central tube section 620 may be made of a non-magnetic and non-conductive material to reduce undesirable effects such as eddy currents, while the material for the magnet cap 635 may be selected with a greater emphasis on its acoustical properties rather than its conductivity. In a headphone application, for example, the magnet cap 635 may be the part of the transducer that is placed in close proximity to or in contact with the pinna or meatus of the user's ear and may be the surface that radiates most of the sound heard by the listener. The use of a material with the proper mechanical properties may be very important for achieving the desired acoustical performance. For example, the flexural stiffness and damping properties of the material may be selected to yield a well-damped structural resonance at high frequencies, to enhance the high-frequency response of the acoustic transducer.

Figure 7:
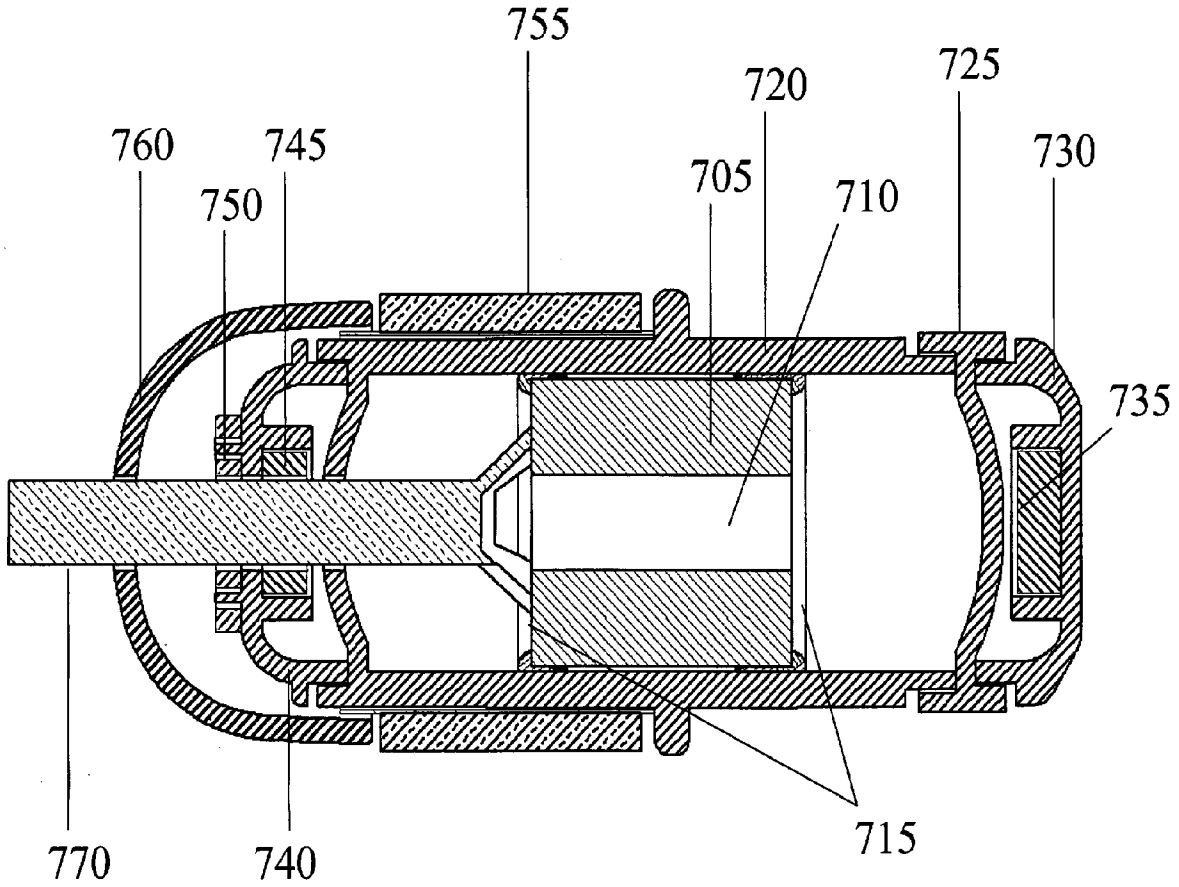
FIG. 7 is a schematic cross-sectional illustration of an implementation of an acoustic transducer according to the present invention in which the tube-coil assembly is composed of multiple pieces, and the internal magnetic element is attached to a rod that protrudes through one end of the tube-coil assembly and allows the internal magnetic element to be attached to an external structure.

FIG. 7 shows a cross-sectional view of an assembly that facilitates the manufacture of an embodiment of the present invention in which the internal magnetic element is the constrained element. In this embodiment, the internal magnetic element 705 has an annular shape with a hole 710 in the middle to allow air to pass through, and is surrounded on either end by rings 715 of a ferromagnetic liquid that act as a lubricant to reduce the friction during the relative motion between the internal magnetic element 705 and the tube-coil assembly. The tube-coil assembly is composed of a central section 720, a closing cap 725, a magnet cap 730 that holds a permanent magnet 735, another magnet cap 740 that holds a permanent magnet 745 and a wire connection board 750, the electromagnetic coil 755 and the end cap 760. In this embodiment, the internal magnetic element 705 is permanently attached to a rod 770 made preferably of a non-magnetic and non-conductive material. The rod 770 protrudes through the central tube section 720, the permanent magnet 745, the magnet cap 740, the wire connection board 750, and the end cap 760, and allows the internal magnetic element 705 to be attached to an external structure, thereby making the internal magnetic element 705 the constrained element of this acoustic transducer. The tube-coil assembly is not attached to any structure and is therefore free to vibrate more than in the embodiment illustrated in FIG. 6.

Figure 8:
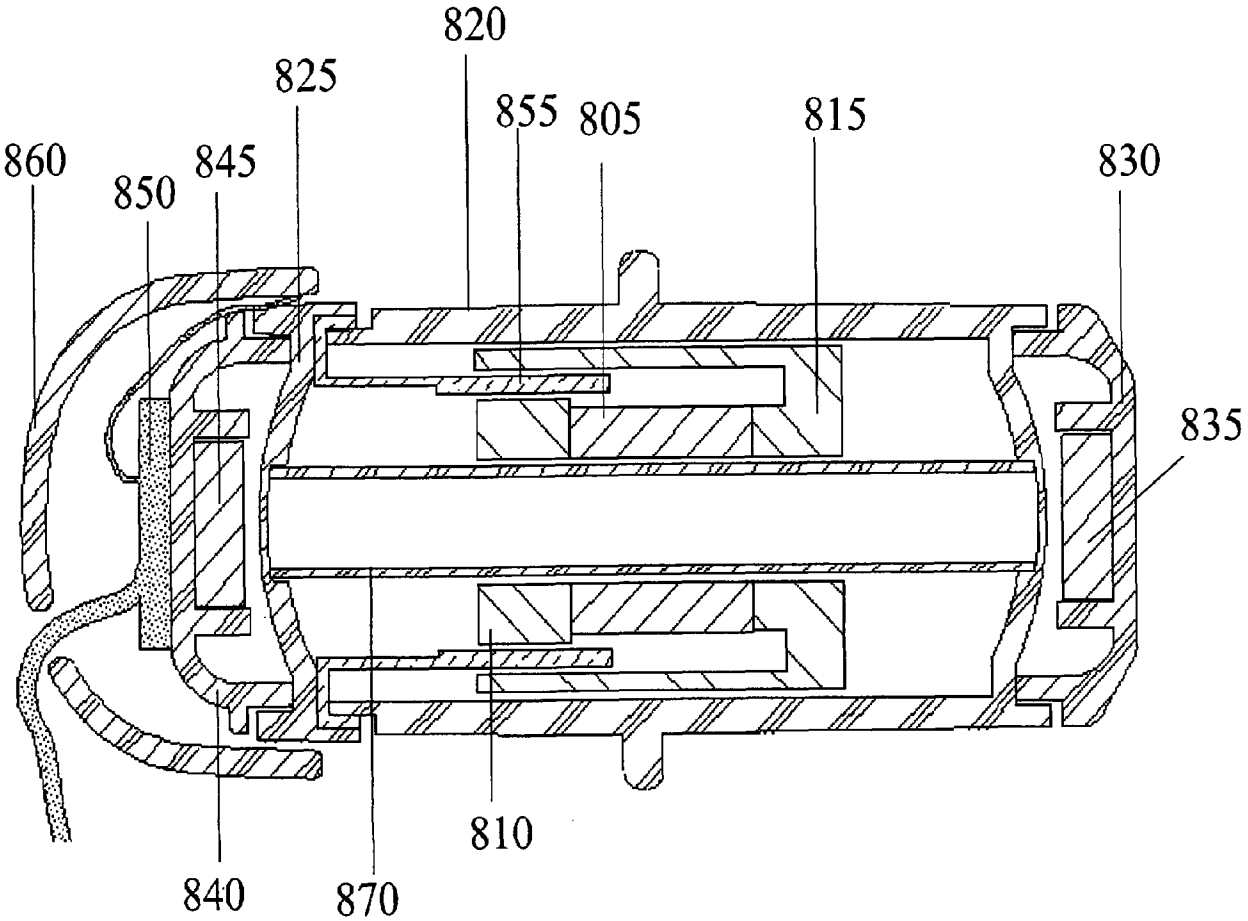
FIG. 8 is a schematic cross-sectional illustration of an implementation of an acoustic transducer according to the present invention in which the tube-coil assembly is composed of multiple pieces and the internal magnetic element uses a structure similar to the motors of conventional transducers.

FIG. 8 shows a cross-sectional view of an assembly that facilitates the manufacture of an embodiment of the present invention in which the internal magnetic element uses a structure similar to the motors of conventional transducers. In this embodiment, the internal magnetic element is composed of an annular magnet 805 that is attached on one side to an annular slug 810 made of a ferromagnetic material such as steel, and is attached on the other side to an annular housing 815 also made of a ferromagnetic material such as steel. To constrain the relative motion between the internal magnetic element and the tube-coil assembly to essentially a straight path and to reduce unwanted sideways vibration, the composite internal magnetic element slides on a hollow rod 870 that is made of a non-magnetic, non-conductive and very low-friction material. The outer diameters of the magnet 805 and slug 810 are slightly smaller than the inner diameter of an outer portion of the housing 815, and the gap between them has an annular shape. The electromagnetic coil 855 is attached to the central section of the tube 820 and is centered inside the annular gap between the slug 810 and the outer portion of the housing 815. The tube-coil assembly also includes a closing cap 825, a magnet cap 830 that holds a permanent magnet 835, another magnet cap 840 that holds a permanent magnet 845 and a wire connection board 850, and an end cap 860.

In alternative implementations, magnets attached at locations away from the nominal rest position that apply a repelling restoring force to the internal magnetic element may be used with tubes that are open on either or both ends, and magnets attached at locations at or near the nominal rest position that apply an attracting restoring force to the internal magnetic element may be used with tubes that are closed on either or both ends. Radiation amplifiers may be used with tubes having ends that are either open or closed.

In each of the implementations discussed above, the magnetic fields that apply restoring forces to the internal magnetic element are provided by passive devices such as permanent magnets and ferromagnetic metal foils. These restoring forces may also be provided by active devices such as electromagnets. In some implementations such as the one shown in FIG. 4, the same electromagnetic coils that provide the signal-dependent magnetic field may provide the restoring force by biasing the signal flowing through the coils with an appropriate direct current. Various types of passive and active devices may be used in essentially any combination that may be desired.

The electromagnetic coils may be made of wire or essentially any other suitable conductor that is capable of generating a magnetic field. For implementations that use wire, the total resistance and wire gauge of the one or more electromagnetic coils may conform to what is used in the construction of conventional loudspeaker coils or headphone coils. As an example, in loudspeaker applications the coils may have a nominal resistance of 4 Ohms or 8 Ohms and be constructed with American Wire Gauge (AWG) 30 or AWG 32 copper wire. As another example, in headphone applications, the coils may have a nominal resistance of 16 Ohms or 32 Ohms and be constructed with AWG 34 or AWG 36 copper wire.

Throughout this disclosure, more particular mention has been made of embodiments and implementations of the present invention that have a cylindrical magnetic element located inside a cylindrical tube. Other implementations are possible. For example, the magnetic element and the tube may have a different cross-sectional shape such as a polygon. In addition, the tube may be replaced by another type of structure that suspends the magnetic element and restricts its relative motion to a path that is essentially a straight or curved line along the structure. For example, a straight or curved rod that passes through an opening in the magnetic element may be used. One or more electromagnetic elements may be implemented by coils that are embedded in the rod and the magnetic element is allowed to slide along the rod in response to electrical signals that are applied to the coils. The magnetic element is no longer internal to the supporting structure and may be referred to as a suspended magnetic element rather than an internal magnetic element.

The following pages of the disclosure of this application set forth the contents of a document entitled "Compact Magnetic Suspension Transducer" that is authored by the inventors. Any terms or explanations in the document that indicate or suggest something is required, necessary or preferred with respect to the present invention, or that some value is a minimum, a maximum or an optimum value, do not necessarily represent limitations on the scope of the present invention. To the extent that the document discloses or suggests a limitation that is not discussed in the preceding paragraphs or is inconsistent with something that is discussed in the preceding paragraphs, these limitations and inconsistencies are to be resolved in favor of the disclosure provided by the preceding paragraphs.

What is claimed is:

1. A method for operating an acoustic transducer, comprising:

providing a moving element within a fixed element, wherein the moving element is coupled to surrounding air and comprises a magnetic material;

generating a signal-independent magnetic field to urge the moving element into a rest position when no input signal is received; and generating a signal-dependent force in response to the input signal and applying that signal-dependent force to the moving element to urge the moving element away from the rest position;

whereby the moving element is controlled by a combined influence of the signal-independent magnetic field and the signal-dependent force to generate acoustic vibrations in response to an audio input signal;

wherein said generating the signal-independent magnetic field comprises surrounding at least a portion of an exterior of the fixed element with a magnetic material; and wherein said generating the force in response to the input signal comprises surrounding at least a portion of an exterior of the fixed element with an electromagnetic coil and sending an electrical signal to the coil.

2. The method according to claim 1, further comprising: generating the force by generating a signal-dependent magnetic field in response to the input signal, whereby the moving element is controlled by a combined influence of the signal-independent magnetic field and the signal-dependent magnetic field.

3. The method according to claim 2, wherein said generating the signal-independent magnetic field comprises surrounding the portion of the exterior of the fixed element with a permanent magnetic material.

4. The method according to claim 2, wherein said generating the signal-independent magnetic field comprises surrounding the portion of the exterior of the fixed element with a ferromagnetic foil.

5. The method according to claim 2, further comprising the signal-independent field attracting the moving element.

6. The method according to claim 2, further comprising the signal-independent field repelling the moving element.

7. The method according to claim 1, wherein said providing the moving element comprises providing a moving element including a permanent magnetic material.

8. The method according to claim 1, wherein said providing the moving element comprises providing a moving element including a ferromagnetic material.

* * * * *